US006765846B2

(12) United States Patent
Saitou et al.

(10) Patent No.: US 6,765,846 B2
(45) Date of Patent: Jul. 20, 2004

(54) ANTENNA APPARATUS AND WRISTWATCH RADIO COMMUNICATION DEVICE USING SAME

(75) Inventors: Yutaka Saitou, Nomi-gun (JP); Isamu Nagano, Kanazawa (JP); Hiroshi Haruki, Yokohama (JP)

(73) Assignee: Matsushita Electric Industrial Co., Ltd. (JP)

( * ) Notice: Subject to any disclaimer, the term of this patent is extended or adjusted under 35 U.S.C. 154(b) by 42 days.

(21) Appl. No.: 09/757,635

(22) Filed: Jan. 11, 2001

(65) Prior Publication Data

US 2001/0010662 A1 Aug. 2, 2001

(30) Foreign Application Priority Data

Jan. 28, 2000 (JP) ..... 2000-019425

(51) Int. Cl.[7] ..... G04B 47/00; G04B 37/00
(52) U.S. Cl. ..... 368/10; 368/281; 343/718
(58) Field of Search ..... 345/715, 720, 345/741, 743, 702, 708, 368, 455; 368/47, 10, 281; 455/575

(56) References Cited

U.S. PATENT DOCUMENTS 4,873,527 A * 10/1989 Tan
5,072,231 A 12/1991 Koyama ..... 343/718
5,128,686 A 7/1992 Tan et al.
5,280,296 A * 1/1994 Tan et al. ..... 368/10
5,530,453 A * 6/1996 Koyama ..... 343/178
5,673,054 A * 9/1997 Hama ..... 343/718
5,926,139 A * 7/1999 Korisch
6,005,525 A * 12/1999 Kivela
6,212,414 B1 * 4/2001 Alameh et al. ..... 368/10

FOREIGN PATENT DOCUMENTS

| | | |
|---|---|---|
| EP | 0334297 | 9/1989 |
| JP | 5-21536 | 3/1993 |
| JP | 5-276056 | 10/1993 |
| JP | 6-188809 | 7/1994 |
| JP | 8-274536 | 10/1996 |
| JP | 11-55143 | 2/1999 |

* cited by examiner

*Primary Examiner*—David Martin
*Assistant Examiner*—Jeanne-Marguerite Goodwin
(74) *Attorney, Agent, or Firm*—Parkhurst & Wendel, L.L.P.

(57) ABSTRACT

An antenna apparatus for use in a wristwatch radio communication device equipped with, for example, a PHS is provided. The antenna apparatus includes a loop conductor and a feed. The loop conductor has a given length and connects electrically at one end to a ground plate installed in the wristwatch radio communication device. The feed is disposed between the other end of the loop conductor and the ground plate. This provides a higher horizontal pattern average gain both during conversation and waiting times of radio communication.

8 Claims, 9 Drawing Sheets

ANTENNA APPARATUS AND WRISTWATCH RADIO COMMUNICATION DEVICE USING SAME

BACKGROUND OF THE INVENTION

1. Technical Field of the Invention

The present invention relates generally to an antenna apparatus for use in wristwatch radio communication devices which have, for example, a PHS (Personal Handyphone System) employing a radio frequency higher than a UHF band, and more particularly to an antenna apparatus suitable for wearing on the user's wrist which is designed to assure stable and reliable communications during conversation and waiting time and a wristwatch radio communication device using the antenna apparatus.

2. Background Art

Recently, mobile telecommunication systems such as mobile telephones and PHSs have been developed rapidly, and portable radio units are being miniaturized. As such portable radio units, there have been proposed wristwatch radio communication devices. As a typical one of the wristwatch radio communication devices, wristwatch pagers are put into practical use. For instance, Japanese Utility Model First Publication No. 5-21536 teaches a helical antenna built in a wristband. Japanese Patent First Publication No. 5-276056 teaches a loop antenna mounted in a wristband. Japanese Patent First Publication No. 6-188809 teaches a loop antenna installed in a cover of a wristwatch casing. Japanese Patent First Publication No. 8-274536 discloses a slot antenna disposed in a wristwatch casing.

Additionally, as a wristwatch radio antenna used in PHSs whose radio frequency is, for example, 1.9 GHz, Japanese Patent First Publication No. 11-55143 proposes a one-wavelength loop antenna installed in a wristwatch cover.

Usually, as a performance index for antennas of mobile telephones such as PHSs, a horizontal pattern average gain (PAG) when the antenna is worn on a body of a person is used. If a person's body wearing a mobile telephone antenna is positioned at the center of a spherical coordinate system with a head oriented toward the zenith, PAG may be given by an equation below.

$$PAG = \frac{1}{2\pi}\int_0^{2\pi}\left[G_\theta(\phi) + \frac{G_\phi(\phi)}{XPR}\right]d\phi$$

where $G\theta(\phi)$ and $G\phi(\phi)$ are power patterns of vertically and horizontally polarized components in a horizontal plane (X-Y plane), respectively, and XPR is a cross polarization discrimination of an incoming wave received by the antenna, or a power ratio of the vertically polarized component to the horizontally polarized component. A typical XPR of land mobile communication systems in multi-path environmental conditions is known to be 4 to 9 dB meaning that the power of the vertical polarization of an incoming wave is higher than that of the horizontal polarization by 4 to 9 dB. Thus, the above equation indicates an average of the power patterns in a horizontal plane derived by weighting the vertical polarization by the XPR. In the following discussion, a cross polarization discrimination XPR of 6 dB that is a typical value in urban area.

In order to assure a high communication quality, antennas of radio systems such as PHSs require a PAG greater than about −6 dBd (half wavelength dipole ratio). Typical telephone units attach great importance in design to the talk position when a speaker is placed close to the user's ear. The wristwatch radio communication devices, however, must consider two use conditions: one is a condition in which the device worn on the wrist is placed in front of the user's face for conversation, and the second is a condition in which the device worn on the wrist is held on the side of the waist during a waiting time. In the two conditions, the PAG must be −6 dBd or more. The one-wavelength loop antenna built in the wristwatch cover, as described above, is designed to improve the performance of the antenna both in cases in which the cover is opened during the conversation time and in which the cover is closed during the waiting time.

However, the above described antennas for wristwatch pagers are designed to use a radio frequency of less than 300 MHz and have a lower antenna gain usually less than −15 dBd. It is, thus, difficult to use such antennas in wristwatch radio communication devices employing the PHS whose radio frequency is higher than the UHF band.

The one-wavelength loop antenna, as taught in Japanese Patent First Publication No. 11-55143, for use in PHS wristwatch radio communication devices improves the antenna performance during the conversation and waiting times to a certain extent, but basically uses a balanced feed structure, as shown in FIG. 2, that is undesirably complex. Additionally, this antenna is also not optimized in view of characteristics of radiation incorporating the whole of the user's body, which will lead to a problem that a PAG more than −6 dBd cannot be assured both during the conversation and waiting times.

The above one-wavelength loop antenna is so used that the bi-directional directivity thereof is oriented to right and left of the user's body during the conversation time and has a problem that the radiation toward the front of the user's body is decreased. The acquisition of vertical polarization requires installation of a feed on a side of the cover which is perpendicular to the wristwatch casing when opened, thus needing a feed cable for connection to a radio circuit arranged in the wristwatch casing. The impedance of the loop antenna when the cover is opened is high, as much as 100 Ω, thus resulting in a difficulty in matching with a 50 Ω impedance of the radio circuit.

SUMMARY OF THE INVENTION

It is therefore a principal object of the invention to avoid the disadvantages of the prior art.

It is another object of the invention to provide an antenna apparatus which has a simple feed structure to assure high antenna performance both during conversation and waiting times in a portable radio telephone and a wristwatch radio communication device using the same.

According to one aspect of the invention, there is provided an antenna apparatus for use in a wristwatch radio communication device. The antenna apparatus comprises: (a) a loop conductor having a given length, the loop conductor being connected electrically at one end to a ground member installed in the wristwatch radio communication device; and (b) a feed disposed between the other end of the loop conductor and the ground member.

The loop conductor is rectangular and has a circumferential length equivalent to a wavelength of a frequency used in radio communication of the wristwatch radio communication device. The loop conductor has at least one side disposed closer to the ground member installed in the wristwatch radio communication device.

The loop conductor is arranged along a periphery of an openable cover installed on the wristwatch radio communication device. The loop conductor, the ground member, and the feed are connected electrically through a support mechanism designed to support the cover pivotably on a body of the wristwatch radio communication device.

The support mechanism is provided on a side of the body of the wristwatch radio communication device to which a wristband is attached.

The loop conductor is printed on a board installed within the cover of the wristwatch radio communication device.

The board has a matching circuit disposed thereon.

A ground conductor is further disposed within the wristband which is connected electrically to the ground member in the wristwatch radio communication device.

According to another aspect of the invention, there is provided a wristwatch radio communication device which comprises: (a) a wristwatch body having a radio communication circuit; (b) a ground member installed in the wristwatch body; and (c) an antenna. The antenna includes a loop conductor having a given length, connected electrically at one end to the ground member and a feed disposed between the other end of the loop conductor and the ground member.

BRIEF DESPCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

DESCRIPTION OF THE PREFERRED EMBODIMENTS

Figure 1:
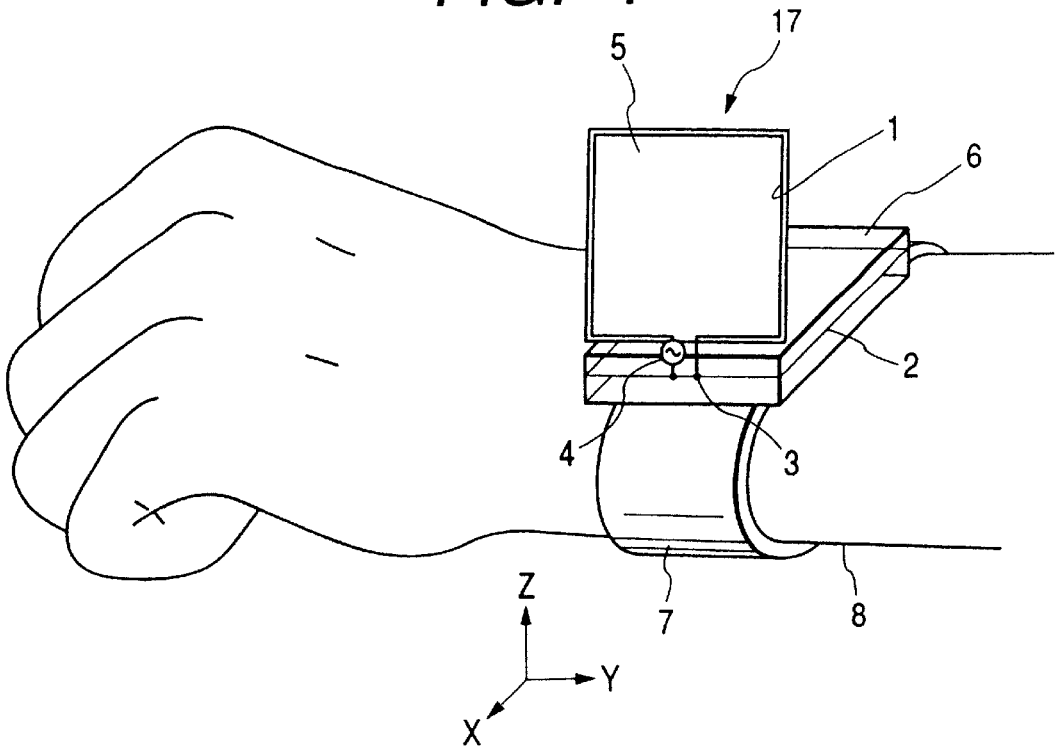
FIG. 1 is a perspective view which shows a wristwatch radio communication device equipped with an antenna apparatus worn on the user's wrist.

Referring to the drawings, wherein like reference numbers refer to like parts in several views, particularly to FIG. 1, there is shown an antenna apparatus 17 according to the first embodiment of the invention which is installed in a wristwatch radio communication device.

The wristwatch radio communication device includes generally a wristwatch body 6, an openable cover 5, and a strap 7 and is worn on a wrist 8 of the user by the strap 7 when used. In the following discussion, it is assumed, as an example, that the wristwatch radio communication device has installed in the wristwatch body 6 the PHS system whose radio frequency is 1.9 GHz. The antenna apparatus 17 includes a loop antenna 1 made of a conductive strip. The loop antenna 1 is fitted in the cover 5 pivotably held on the wristwatch body 6 and connected at one end to a ground plate 2 through a ground terminal 3 and at the other end to a feed 4. The ground plate 2 is substantially at zero potential.

The loop antenna 1 is made of, for example, copper wire and has a circumferential length substantially equivalent to one wavelength (about 158 mm) and mounted along the periphery of the cover 5. The cover 5 is made of resin material so as not to impinge upon the loop antenna 1 electrically. The ground plate 2 works as ground and connects with a radio circuit board installed in the wristwatch body 6 and is mounted on almost all surfaces of the wristwatch body 6. The loop antenna 1 is, as described above, connected at one end to the ground plate 2 through the ground terminal 3 and at the other end to the feed 4 disposed between the loop antenna 1 and the ground plate 2. The ground terminal 3 and the feed 4 are arranged substantially on a central portion of a side of the wristwatch body 6 to which the strap 7 is attached. With these arrangements, the loop antenna 1 is subjected to an unbalanced feed on the ground plate 2 working as a finite ground plane.

The operation of a conventional one-wavelength loop antenna will be discussed below with reference to FIGS. 2 and 3 for comparison with the loop antenna 1 of the invention.

Figure 2:
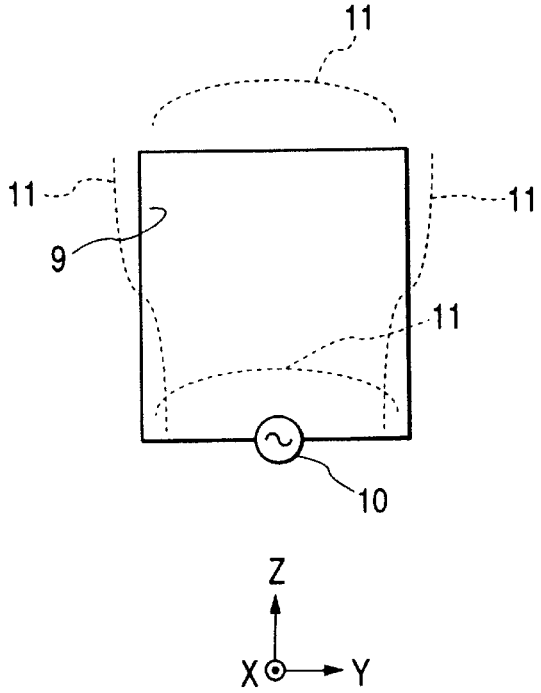
FIG. 2 PRIOR ART
FIG. 2 shows a current distribution of a conventional one-wavelength loop antenna undergoing a balanced feed.
Figure 3:
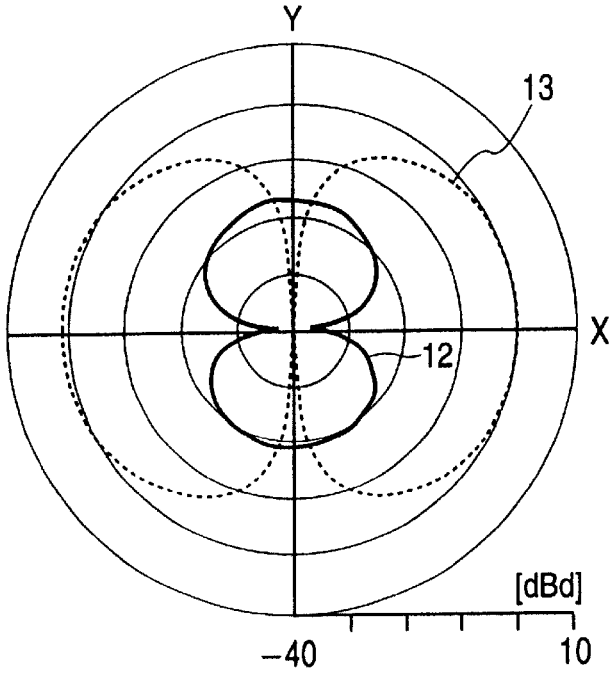
FIG. 3 PRIOR ART
FIG. 3 shows the directivity of radiation from the loop antenna of FIG. 2.

FIG. 2 shows a current distribution of the one-wavelength antenna undergoing a balanced feed. The feed 10 is disposed on the center of a horizontal side of the one-wavelength loop antenna 9. The current distribution is illustrated by a broken line 11. FIG. 3 shows the directivity of radiation from the loop antenna 9 on the X-Y plane. The reference numbers 12 and 13 denote a horizontally polarized component and a vertically polarized component of the radiation from the loop antenna 9 on the X-Y plane, respectively. As clearly shown in the drawing, the horizontally polarized component 13 is higher in level than the vertically polarized component 12. The horizontal polarization is, thus, principal polarization. The maximum radiation is oriented in each of X-direction and −X direction. Specifically, the loop antenna 9 is bi-directional in directivity.

However, in a radio system such as the PHS, the principal polarization is the vertical polarization. It is, thus, impossible for the structure of FIG. 2 to provide the antenna performance most suitable for the PHS. Therefore, if the loop antenna 9 of FIG. 2 is installed in a wristwatch cover such as the one as discussed in the introductory part of this application for radio communication, the feed 10 needs to be disposed on a vertical side of the loop antenna 9 to increase the level of the vertically polarized component 12. This requires a relatively longer connection of the vertical side of the loop antenna 9 on which the feed 10 is installed to the wristwatch using a feeder cable. In this case, the feed point impedance becomes more than 100 Ω. The balanced feed, thus, requires use of a matching circuit element such as a balun which is capable of changing the impedance.

Figure 4:
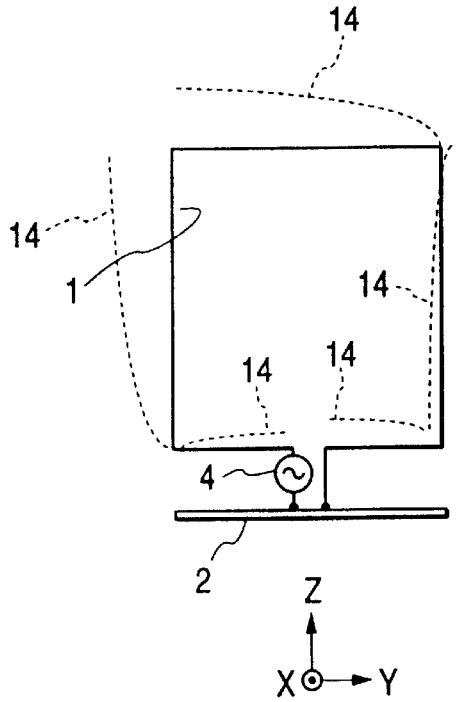
FIG. 4 shows a current distribution of an antenna apparatus according to the first embodiment of the invention.

The operation of the loop antenna 1 in a free space unaffected by the human body will be described below with reference to FIGS. 4 and 5. FIG. 4 shows a current distribution of the antenna apparatus 17 shown in FIG. 1 when placed in the free space. The loop antenna 1 is, as already described, subjected to the unbalanced feed on the ground plate 2, and one of the sides of the loop antenna 1 closet to the feed 4 is located in the vicinity of the ground plate 2, thereby forming the current distribution 14.

Figure 5:
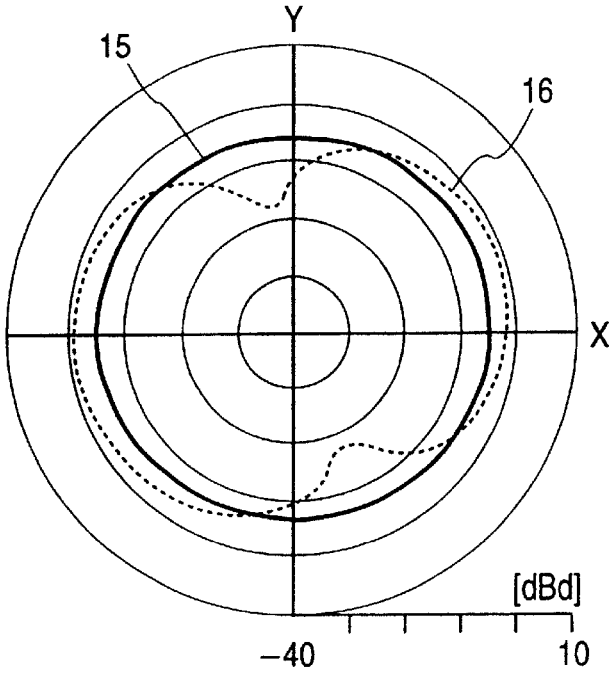
FIG. 5 shows the directivity of radiation from the loop antenna of FIG. 4.

FIG. 5 shows the directivity of radiation from the loop antenna 1 on the X-Y plane. The reference numbers 15 and 16 denote a vertically polarized and a horizontally polarized component of the radiation from the loop antenna 1, respectively. As clearly shown in the drawing, the horizontally polarized component 16 is higher in level than the vertically polarized component 15. As can be seen from the drawing, the vertically polarized component 15 is increased in level as compared with the one in FIG. 3, 50 that the loop antenna 1 will be omnidirectional. The feed point impedance is approximately 70 Ω, thereby facilitating ease of matching with the impedance of the radio circuit that is 50 Ω. It also becomes possible to provide the unbalanced feed under the condition that the ground plate 2 is at ground potential, thereby allowing the matching circuit to be implemented by small-sized and inexpensive lumped-constant elements (a chip capacitor and a chip coil).

The status of the wristwatch radio communication device equipped with the antenna apparatus 17 during the conversation time (i.e., affected by the human body) and the directivity of radiation on the X-Y plane will be discussed with reference to FIGS. 6 and 7.

Figure 6:
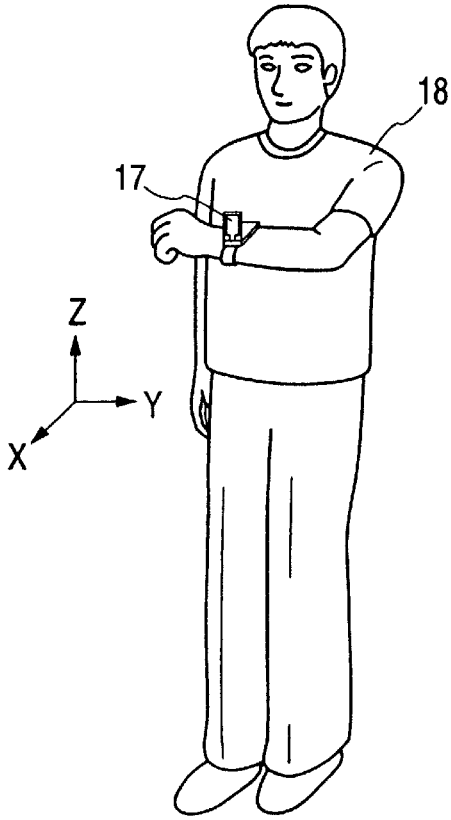
FIG. 6 is a perspective view which shows a wristwatch radio communication device held in front of the user's face for conversation.
Figure 7:
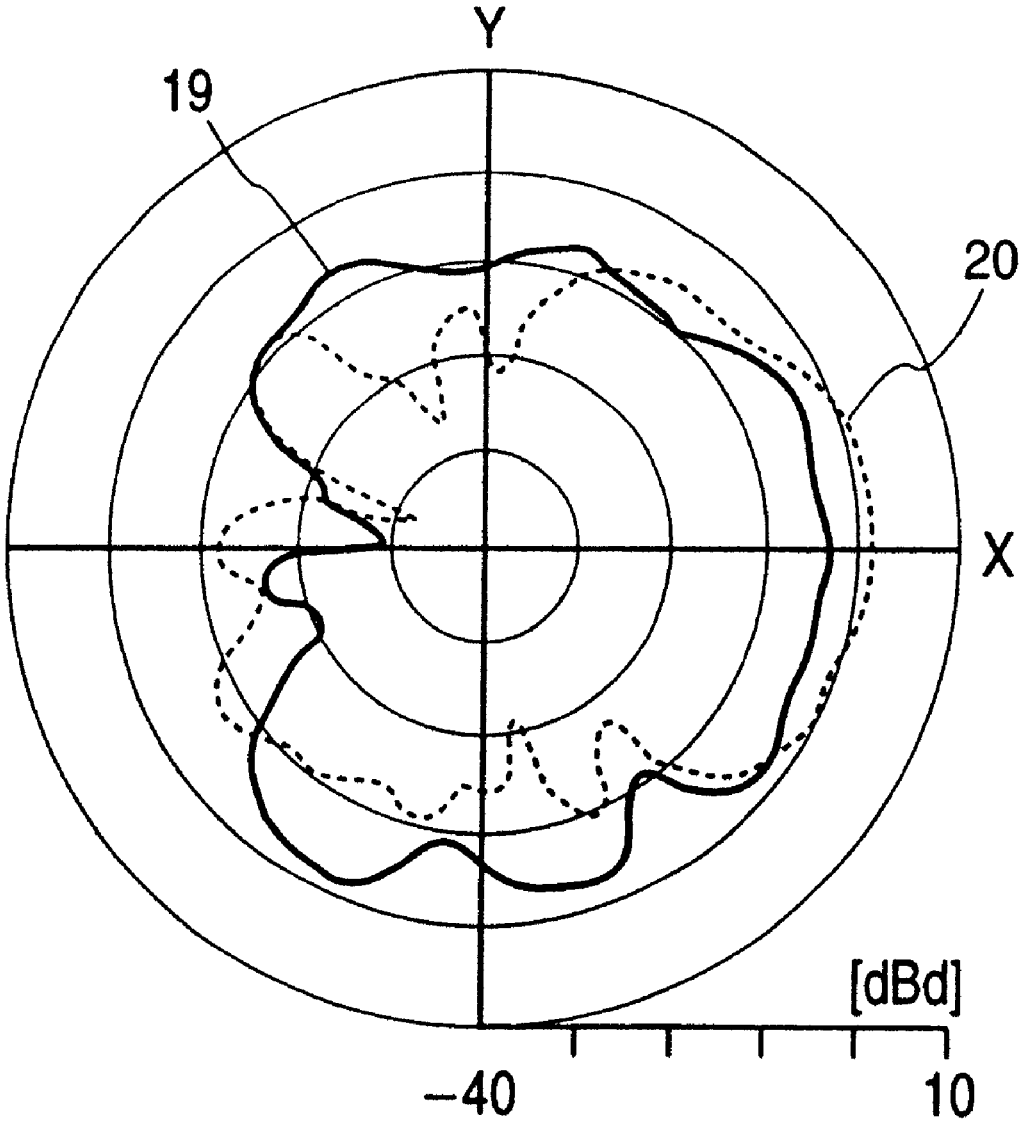
FIG. 7 shows the directivity or radiation pattern of an antenna apparatus installed in the wristwatch radio communication device of FIG. 6.

FIG. 6 shows the wristwatch radio communication device held by the user 18 in front of the face to have a conversation. FIG. 7 shows the directivity or radiation pattern of the antenna apparatus 17 on the X-Y plane. The reference numbers 19 and 20 denote a vertically polarized component and a horizontally polarized component of the radiation from the loop antenna 1, respectively. As clearly shown in the drawing, a component radiated backward of the user's body (i.e., −X direction) is relatively small, but the vertically and horizontally polarized components 19 and 20 are radiated substantially to all directions at high levels. In this condition, the PAG is approximately −5 dBd.

Figure 8:
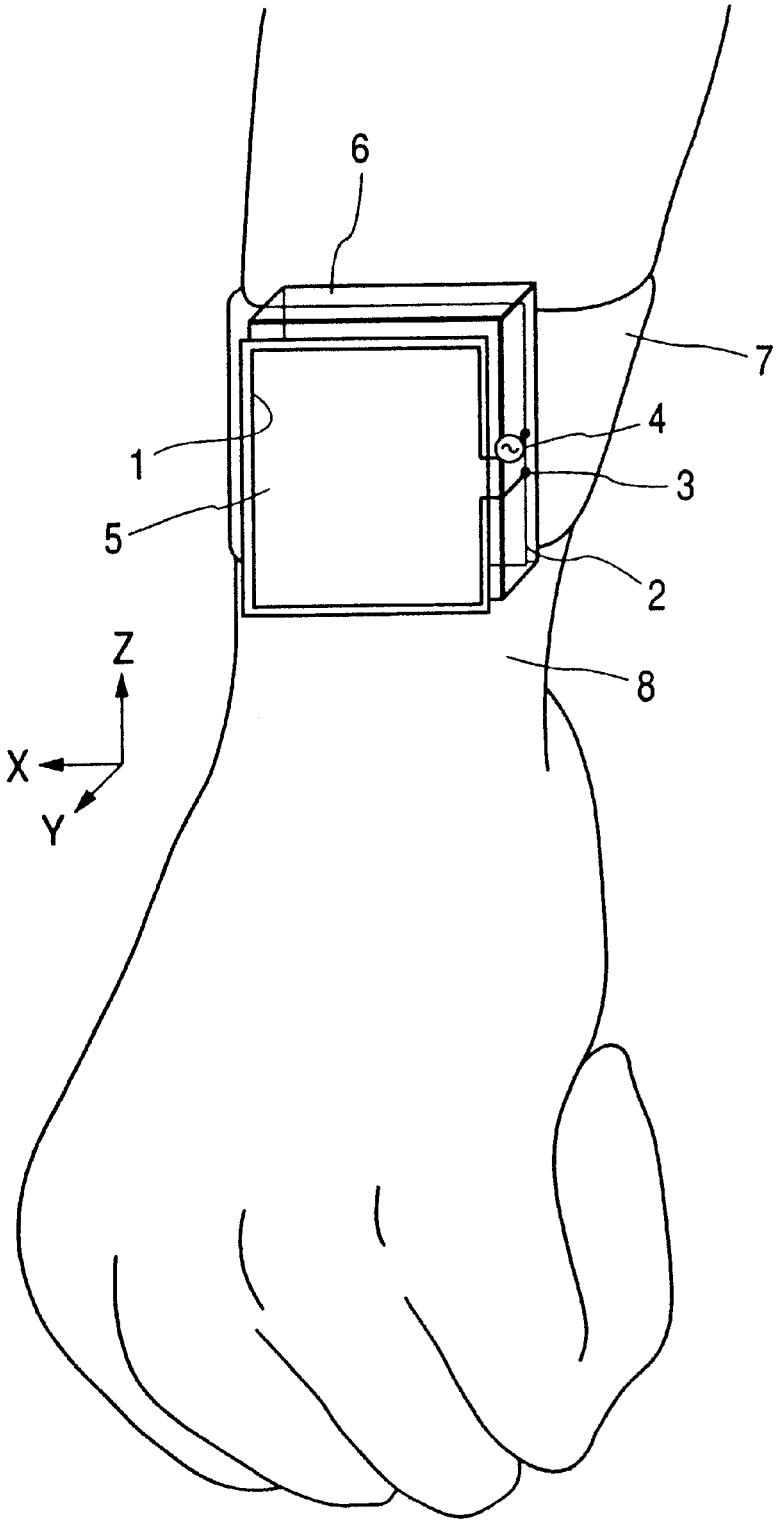
FIG. 8 shows a wristwatch radio communication device worn on the user's wrist extended straight on the side of the waist with a cover closed.

The status of the wristwatch radio communication device of this embodiment during the waiting time will be described with reference to FIG. 8. FIG. 8 shows the wristwatch radio communication device worn on the wrist 8 of the user extended straight on the side of the waist with the cover 5 closed. The x-coordinate axis is, like other drawings, oriented forward of the user's body. The ground terminal 3 and the feed 4 are, as described above, provided on the side of the wristwatch body 6 to which the strap 7 is attached and thus, in the shown condition, located on the central portion of the vertical side of the cover 5.

Figure 9:
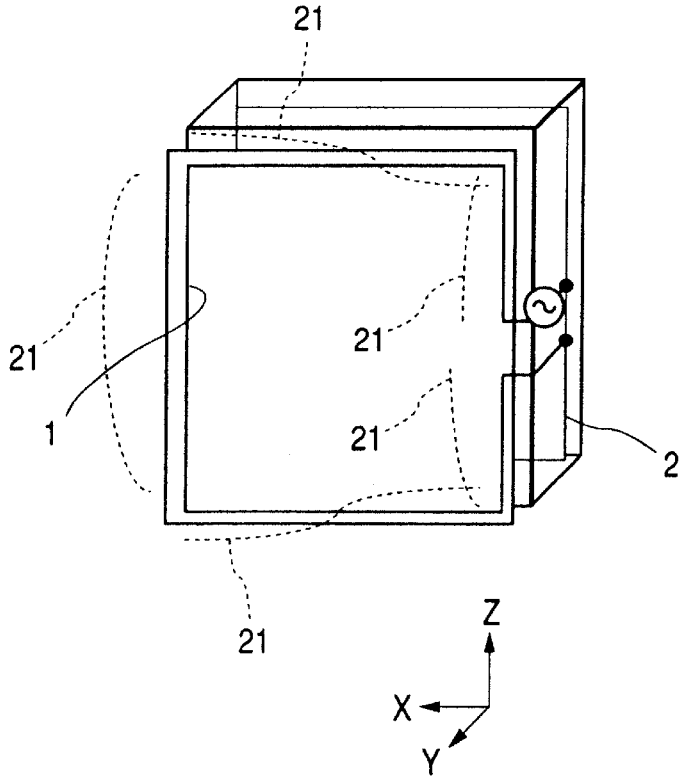
FIG. 9 shows a current distribution of an antenna apparatus installed in the wristwatch radio communication device of FIG. 8 during a waiting time which is unaffected by the user's body.

FIG. 9 shows a current distribution of the antenna apparatus 17 during the waiting time which is, like FIG. 8, unaffected by the user's body. The whole of the loop antenna 1 is located at an interval of, for example, 5 mm away from the ground plate 2, so that electromagnetic interaction of the loop antenna 1 and the ground plate 2 establishes the current distribution 21. The current distribution 21 is substantially equal to that of the loop antenna 1 in FIG. 4 when inclined at 90°.

Figure 10:
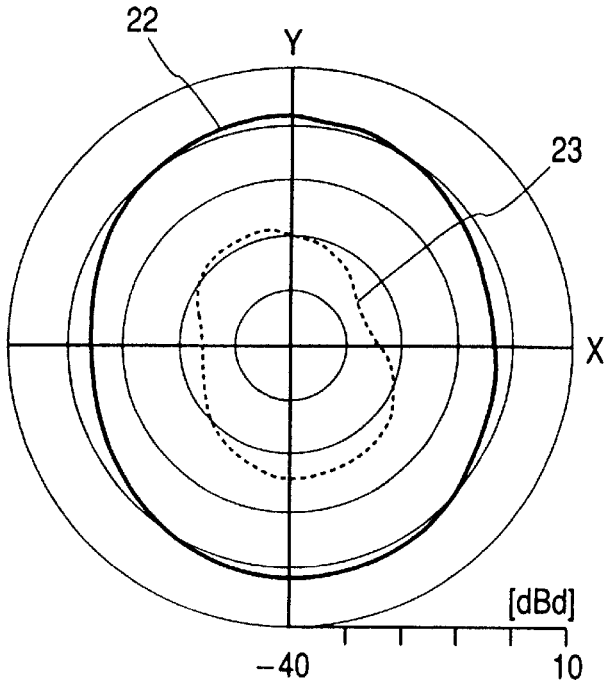
FIG. 10 shows the directivity of radiation from a loop antenna of FIG. 9 on the X-Y plane during a waiting time.

FIG. 10 shows the directivity of radiation from the loop antenna 1 shown in FIG. 9 on the X-Y plane during the waiting time. The reference numbers 22 and 23 denote a vertically polarized component and a horizontally polarized component of the radiation from the loop antenna 1, respectively. As can be seen in the drawing, the vertical polarization is the principal polarization. The maximum radiation is oriented to the Y and −Y directions.

The status of the wristwatch radio communication device of this embodiment during the waiting time and the directivity of radiation on the X-Y plane will be discussed with reference to FIGS. 11 and 12.

Figure 11:
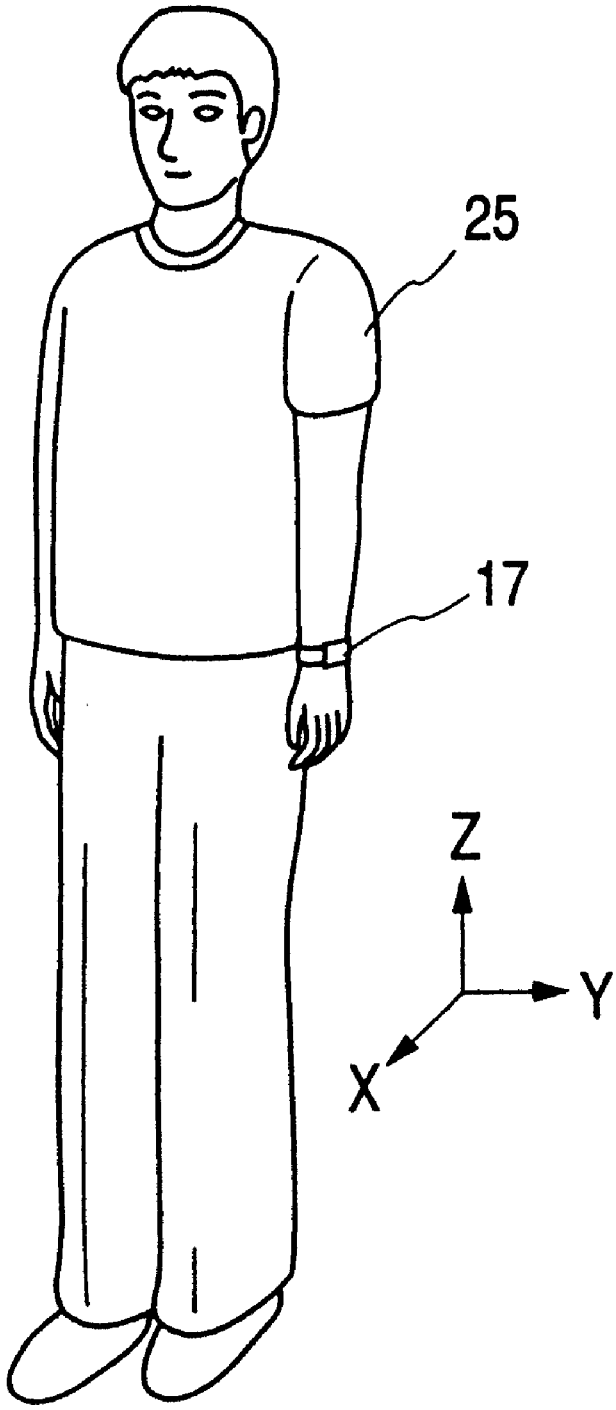
FIG. 11 shows a wristwatch radio communication device worn on the user's wrist extended downward during a waiting time.

FIG. 11 shows the wristwatch radio communication device worn on the wrist of the user 25 extended downward during the waiting time (i.e., affected by the human body). The cover 5 is closed.

Figure 12:
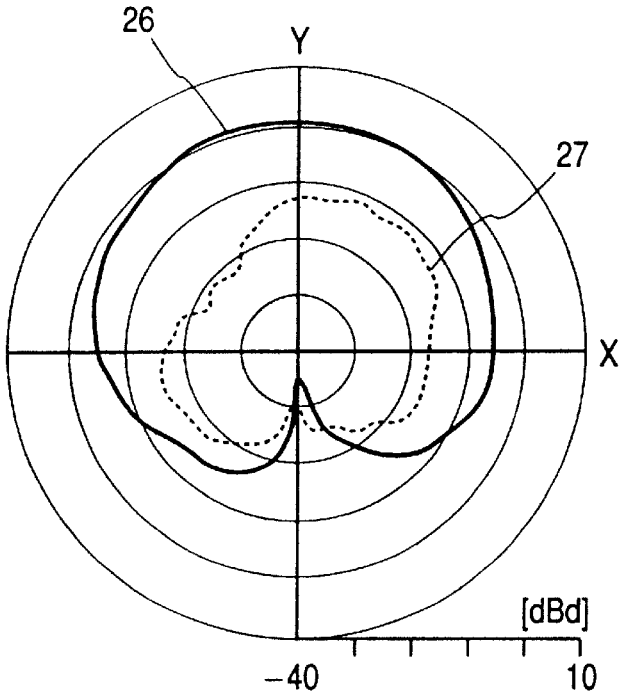
FIG. 12 shows the directivity or radiation pattern of an antenna apparatus installed in the wristwatch radio communication device of FIG. 11 on the X-Y plane.

FIG. 12 shows the directivity or radiation pattern of the antenna apparatus 17 in FIG. 11 on the X-Y plane. The reference numbers 26 and 27 denote a vertically polarized component and a horizontally polarized component of the radiation from the loop antenna 1, respectively. In this case, the body of the user 25, especially the vertically extending arm works as a reflective object, so that the loop antenna 1 will have substantially the same directivity as that of a one-wavelength loop antenna with a reflective plate. The radiation is concentrated on the half of the X-Y plane on the side of the Y-direction, but the PAG averaged over the X-Y plane shows −3 dBd. The radio waves propagated to or from mobile telecommunication devices usually contain waves reflected from buildings etc., so that the horizontal distribution of incoming waves may be viewed to be uniform. Therefore, even when the radiation is concentrated, as shown in FIG. 12, on the half of the X-Y plane, a higher transmission quality is assured as long as the PAG is high.

As apparent from the above discussion, the antenna apparatus 17 of this embodiment is designed to provide the unbalanced feed to the loop antenna 1 through the feed 4 disposed between the ground plate 2 and the side of the wristwatch body 6 close to the end of the strap 7, thereby causing the vertically polarized component of the antenna radiation to be the principal polarized component, thus assuring a higher PAG both during the conversation and waiting times.

The length of the loop antenna 1 is not limited to one wavelength of the used radio frequency and may be any other value. The shape of the loop antenna 1 may be oval. This also offers operational effects similar to that in the case where the loop antenna 1 is rectangular.

Figure 13:
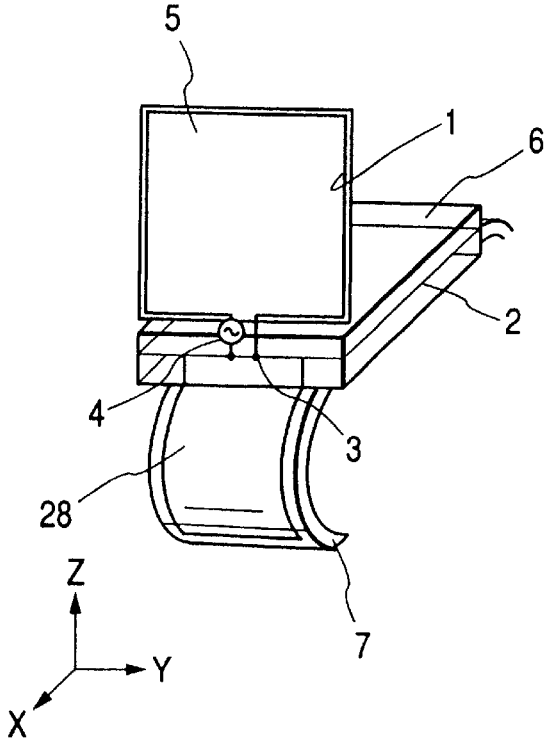
FIG. 13 is a perspective view which shows a wristwatch radio communication device according to the second embodiment of the invention.

FIG. 13 shows a wristwatch radio communication device according to the second embodiment of the invention which is different from the first embodiment in that a ground conductor 28 is embedded in the strap 7. Other arrangements are identical, and explanation thereof in detail will be omitted here.

The ground conductor 28 is formed by a strip of copper foil which has, for example, a length of 30 mm and a width of 20 mm and disposed within the resinous strap 7. The ground conductor 28 extends inside the wristwatch body 6 and connects with the ground plate 2 electrically, thereby causing the part of current distributed over the ground plate 2 to flow to the ground conductor 28, resulting in a change in directivity of the loop antenna 1.

Figure 14:
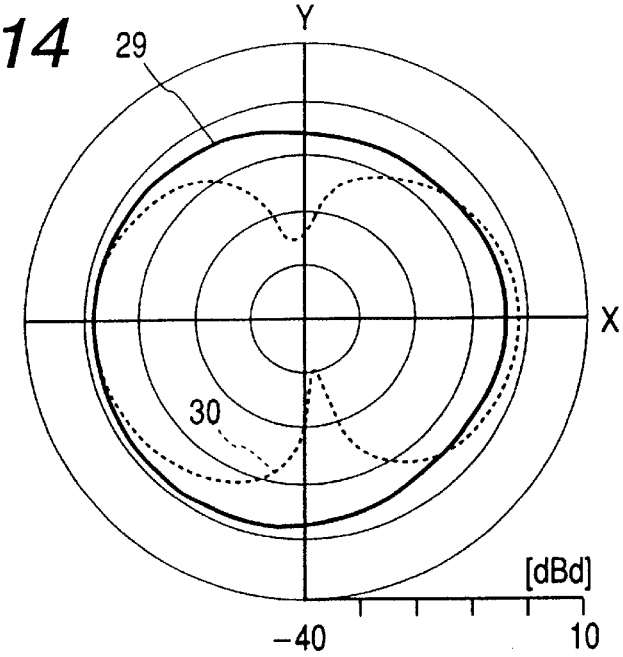
FIG. 14 shows the directivity or radiation pattern of an antenna apparatus installed in the wristwatch radio communication device of FIG. 13 on the X-Y plane.

FIG. 14 shows the directivity or radiation pattern of the antenna apparatus of FIG. 13 on the X-Y plane when unaffected by the human body. The reference numbers 29 and 30 denote a vertically polarized component and a horizontally polarized component of the radiation from the loop antenna 1, respectively. Comparison of FIG. 14 with FIG. 5 shows that the vertically polarized component 29 is higher on average than the vertically polarized component 15 by 2 dB. This is because the direction of maximum radiation on a vertical plane is changed to the horizontal direction (i . e., the X-Y direction), thereby resulting in an increase in PAG during conversation by 2 dB when the wristwatch radio communication device of this embodiment is worn on the user's wrist. Specifically, the PAG shows approximately −3 dBd.

The ground conductor 28 may alternatively be made of conductive wire. The same effects may also be achieved by forming the strap 7 by a metallic material without use of the ground conductor 28.

Figure 15:
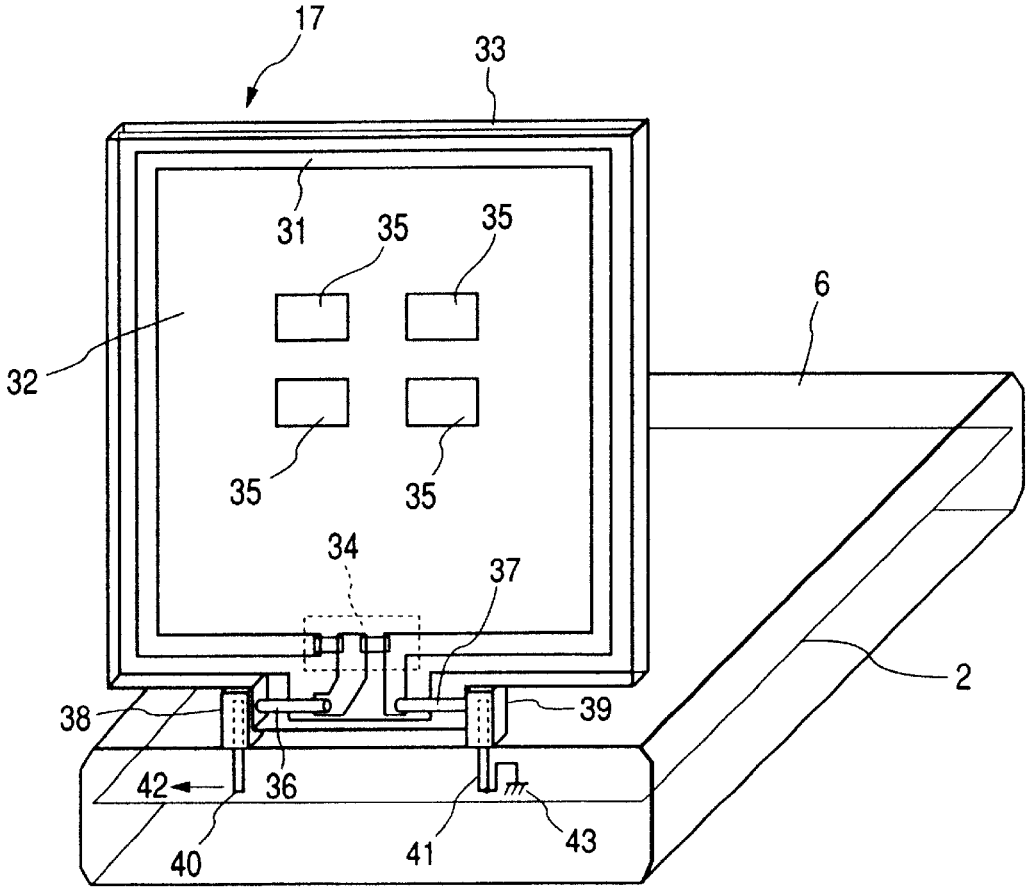
FIG. 15 is a perspective view which shows a wristwatch radio communication device according to the third embodiment of the invention.

FIG. 15 shows a wristwatch radio communication device according to the third embodiment of the invention. The same reference numbers as employed in the first embodiment refer to the same parts, and explanation thereof in detail will be omitted here.

The antenna apparatus 17 has a loop pattern 31 printed on a board 32 disposed within the cover 33. The cover 33 is made of a resin material so as not to affect the operation of the antenna apparatus 17 and hinged on an end of the wristwatch body 6. The printed board 32 has switching elements 35 mounted thereon. The loop pattern 31 is formed by a strip of copper foil which is printed along the periphery of the printed board 32 and has a width of 1 mm and works as a loop antenna.

The antenna apparatus 17 also includes a matching circuit 34. The matching circuit 34 consists of a chip capacitor and a chip coil mounted on the printed board 32 and works at an operational frequency of 1.9 GHz to change the impedance of the loop pattern 31 to 50 Ω. The matching circuit 32 is connected to metallic support shafts 36 and 37 through printed conductive pattern. The support shafts 36 and 37 hold the cover 33 pivotably and connect electrically with connecting terminals 40 and 41 through hinges 38 and 39. The connecting terminal 40 is coupled with a radio feed circuit 42 installed in the wristwatch body 6. The connecting terminal 41 is coupled with the ground plate 2 through a ground terminal 43. Other arrangements are identical with those in the first embodiment, and explanation thereof in detail will be omitted here.

The loop antenna is, as described above, formed by use of the printed board 32, thereby also facilitating ease of installation of the matching circuit 34. Further, only the cover 33 in which the printed board 32 having mounted thereon the matching circuit 34 is installed may be handled as an antenna element, thus resulting in improvement of the productivity in terms of a performance check in a manufacturing process.

A liquid-crystal display may be mounted on the printed board 32. The hinge mechanism supporting the cover 33 pivotably is not limited to the one shown in FIG. 15 and may be implemented by any other structure designed to hold the cover 33 to be openable and achieve transmission of a feed signal from the antenna pattern 31 to the wristwatch body 6.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. An antenna apparatus for a wristwatch radio communication device comprising:

a loop conductor having a circumferential length equivalent to a wavelength of a frequency used in radio communication with the wristwatch radio communication device and first and second ends, said loop conductor being directly connected electrically at said first end to a ground member in a wristwatch radio communication device, said loop substantially defining a plane that is substantially parallel to the length direction of a wristwatch radio wearer's arm; and a feed directly connected to said second end of said loop conductor and disposed between said second end and the ground member.

2. An antenna apparatus as set forth in claim 1, wherein said loop conductor is rectangular and has at least one side located closer to the ground member installed in the wristwatch radio communication device.

3. An antenna apparatus as set forth in claim 1, wherein said loop conductor is arranged along a periphery of an openable cover installed on the wristwatch radio communication device, and wherein said loop conductor, the ground member, and said feed are connected electrically through a support mechanism designed to support the cover pivotably on a body of the wristwatch radio communication device.

4. An antenna apparatus as set forth in claim 3, wherein said support mechanism is provided on a side of the body of the wristwatch radio communication device to which a wristband is attached.

5. An antenna apparatus as set forth in claim 3, wherein said loop conductor is printed on a board installed within the cover of the wristwatch radio communication device.

6. An antenna apparatus as set forth in claim 5, wherein said board has a matching circuit disposed thereon.

7. An antenna apparatus as set forth in claim 4, further comprising a ground conductor disposed within the wristband which is connected electrically to the ground member in the wristwatch radio communication device.

8. A wristwatch radio communication device comprising:

a wristwatch body having a radio communication circuit;

a ground member in said wristwatch body; and an antenna including a loop conductor having a circumferential length equivalent to a wavelength of a frequency used in radio communication with the wristwatch radio communication device and first and second ends, said loop conductor being directly connected electrically at said first end to said ground member, and a feed directly connected to said second end of said loop conductor and located between said second end and the ground member, said loop conductor substantially defining a plane that is substantially parallel to the length direction of a wristwatch radio wearer's arm.

* * * * *